US007964812B1

(12) United States Patent
Schwinn

(10) Patent No.: US 7,964,812 B1
(45) Date of Patent: Jun. 21, 2011

(54) SWITCH BOOT

(75) Inventor: Kenneth J. Schwinn, West New York, NJ (US)

(73) Assignee: A.P.M. Hexseal Corporation, Englewood, NJ (US)

( * ) Notice: Subject to any disclaimer, the term of this patent is extended or adjusted under 35 U.S.C. 154(b) by 146 days.

(21) Appl. No.: 12/492,295

(22) Filed: Jun. 26, 2009

(51) Int. Cl.
*H01H 19/06* (2006.01)

(52) U.S. Cl. ..... 200/302.3

(58) Field of Classification Search ..... 200/302.3, 200/302.2, 308, 333; 74/17.8, 18, 18.1, 558.5, 74/566; 277/634, 637
See application file for complete search history.

(56) References Cited

U.S. PATENT DOCUMENTS 2,440,943 A 5/1948 Gonsett et al.
2,462,023 A 2/1949 Johanson et al.
2,539,386 A 1/1951 Albert
2,795,144 A 6/1957 Morse
3,928,742 A * 12/1975 Rule ..... 200/302.3
4,178,806 A 12/1979 Morse
4,298,778 A 11/1981 Beresford-Jones
4,825,023 A 4/1989 Morse
5,788,059 A 8/1998 Jahangiri
6,573,466 B1 * 6/2003 Rapp et al. ..... 200/302.3

* cited by examiner

*Primary Examiner* — Edwin A. Leon
(74) *Attorney, Agent, or Firm* — Arthur Jacob

(57) ABSTRACT

A sealing device and method are disclosed for use in connection with a switch mounted upon a panel by a panel nut engaged with a threaded bushing projecting from the panel. A boot member of a resiliently flexible elastomeric material is placed over the switch and is secured by a mounting nut to the threaded bushing to establish a seal. An annular bearing member is interposed between the terminal end of the threaded bushing and a juxtaposed portion of the boot member so as to protect the juxtaposed portion from damage that might otherwise occur as a result of any direct contact between the terminal end of the threaded bushing and the juxtaposed portion of the boot member.

28 Claims, 5 Drawing Sheets

SWITCH BOOT

BACKGROUND OF THE INVENTION

1. Field of the Invention

The present invention relates generally to a sealing device for use in providing a protective seal over a switch already mounted upon a panel and pertains, more specifically, to a switch boot construction which accommodates various switch installations already existing in the field while promoting longevity of the switch boot itself.

2. Description of Related Art

It has become commonplace to employ sealing devices for installed switches where it is desired to provide for protection against environmental hazards in the vicinity of a switch. In particular, switch boots have been made available for ready fitting over panel-mounted toggle switches without disturbing the existing mounting arrangement of the switches, especially where a toggle switch is mounted to a panel utilizing a front panel mounting nut, and the sealing boot is installed over the switch while maintaining the existing front panel nut in place in the original mounting position.

In order to establish a proper seal in such an installation, the switch boot usually includes a sealing structure located along a basal portion of the switch boot for being placed in sealing engagement with the front panel upon fitting the switch boot over an existing panel-mounted switch. These front-panel mounted switches ordinarily include a threaded bushing which extends axially through the front panel and projects from the face of the front panel along an axial distance which can vary from installation to installation, usually due to differences in the thickness of the front panel and the length of the threaded bushing, thus giving rise to a requirement for accommodating the variations in axial projection encountered in the field, without compromising the effectiveness of the seal provided by the switch boot, or the integrity of the switch boot itself. Although the resilient nature of the materials employed in the construction of conventional switch boots enables some compensation for variations in the axial projection of a threaded bushing by stretching of the resilient material of the switch boot in response to engagement of the resilient material of the switch boot with the threaded bushing, such engagement can induce excessive stresses in the switch boot material, tending to rupture the switch boot, as well as undue galling and wearing away of the material of the switch boot along surfaces contacted by the threaded bushing, all of which contribute to premature failure of the switch boot.

BRIEF SUMMARY OF THE INVENTION

The present invention provides a switch boot construction which accommodates variations in existing switch installations encountered in the field to establish a better seal while avoiding early failure of the seal. As such, the present invention attains several objects and advantages, some of which are summarized as follows: Provides a switch boot for an existing panel-mounted switch with a construction which accommodates variations in existing switch installations encountered in the field to establish an exemplary seal; avoids deleterious direct contact between the resilient material of the switch boot and component parts of a mounted switch to militate against excessive wear leading to damage and consequent premature failure of an installed switch boot; enhances the seal provided by a switch boot and preserves the enhanced seal over a longer service life; enables greater ease of installation of a switch boot and the establishment of an exemplary seal without disturbing the existing mounting arrangement of the switch itself; better accommodates variations in configurations and dimensions of installed switches, as well as variations in existing installations encountered in the field, to accomplish an effective seal with increased longevity; provides a more rugged switch boot, capable of exemplary performance over an extended service life.

The above objects and advantages, as well as further objects and advantages, are attained by the present invention, which may be described briefly as a sealing device for use in connection with a switch mounted upon a panel and having a threaded bushing projecting in an axial direction away from a face of the panel and secured to the panel with a panel nut engaged with the threaded bushing and placed against the face of the panel such that a terminal end of the threaded bushing is spaced an axial distance from the face of the panel, and an actuator extending in the axial direction from the terminal end of the threaded bushing, the sealing device comprising: a boot member having a wall constructed of a resiliently flexible elastomeric material, the boot member including a lower basal section, an upper apical section and an intermediate section between the basal section and the apical section; a mounting nut captured within the basal section for being engaged with and advanced along the threaded bushing of the switch to mount the boot member over the switch, the mounting nut including a bore complementary to the threaded bushing; a chamber in the apical section, the chamber being dimensioned and configured for receiving the actuator of the switch upon mounting the boot member over the switch; a sealing surface on the basal section for engaging the face of the panel in sealing engagement upon advancing the mounting nut onto the threaded bushing to secure the sealing device over the switch; and a bearing member placed within the intermediate section of the boot member, axially between the mounting nut and the apical section, in position to be interposed between the terminal end of the threaded bushing and a juxtaposed portion of the wall of the boot member along the intermediate section upon mounting the boot member upon the switch, the bearing member being constructed of a material less resiliently flexible than the elastomeric material of the wall, such that direct engagement of the terminal end of the threaded bushing with the elastomeric material of the juxtaposed portion of the wall of the intermediate section is precluded while displacement of the apical section relative to the basal section is enabled in the axial direction in response to engagement of the bearing member with the terminal end of the threaded bushing upon advancement of the sealing surface toward sealing engagement with the face of the panel so as to accommodate variations in the axial distance between the terminal end of the threaded bushing and the face of the panel while assuring sealing engagement of the sealing surface with the face of the panel.

In addition, the present invention provides a sealing method for use in connection with sealing a switch with a sealing device, the switch being mounted upon a panel and having a threaded bushing projecting in an axial direction away from a face of the panel and secured to the panel with a panel nut threaded onto the threaded bushing and placed against the face of the panel such that a terminal end of the threaded bushing is spaced an axial distance from the face of the panel, and an actuator extending in the axial direction from the terminal end of the threaded bushing, the sealing method comprising: providing a boot member having a wall constructed of a resiliently flexible elastomeric material, the boot member including a lower basal section, an upper apical section and an intermediate section between the basal section and the apical section; providing a mounting nut captured within the basal section for being engaged with and advanced along the threaded bushing of the switch to mount the boot member over the switch, the mounting nut including a bore complementary to the threaded bushing; providing a chamber in the apical section, the chamber being dimensioned and configured for receiving the actuator of the switch upon mounting the boot member over the switch; providing a sealing surface on the basal section for engaging the face of the panel in sealing engagement upon advancing the mounting nut onto the threaded bushing to secure the sealing device over the switch; placing a bearing member within the intermediate section of the boot member, axially between the mounting nut and the apical section, in position to be interposed between the terminal end of the threaded bushing and a juxtaposed portion of the wall of the boot member along the intermediate section upon mounting the boot member upon the switch, the bearing member being constructed of a material less resiliently flexible than the elastomeric material of the juxtaposed portion of the wall; and engaging the mounting nut with the threaded bushing and moving the sealing device along the threaded bushing in an axial direction toward the panel such that direct engagement of the terminal end of the threaded bushing with the elastomeric material of the wall of the intermediate section is precluded by the interposed bearing member while displacement of the apical section relative to the basal section is enabled in the axial direction away from the panel in response to engagement of the bearing member with the terminal end of the threaded bushing upon axial movement of the sealing surface toward sealing engagement with the face of the panel so as to accommodate variations in the axial distance between the terminal end of the threaded bushing and the face of the panel while assuring sealing engagement of the sealing surface with the face of the panel.

Further, the present invention provides a sealing device for use in connection with a switch mounted upon a panel and having a threaded bushing projecting in an axial direction away from a face of the panel and secured to the panel with a panel nut engaged with the threaded bushing and placed against the face of the panel such that a terminal end of the threaded bushing is spaced an axial distance from the face of the panel, and an actuator extending in the axial direction from the terminal end of the threaded bushing, the sealing device comprising: a boot member having a wall constructed of a resiliently flexible elastomeric material, the boot member including a lower basal section, an upper apical section and an intermediate section between the basal section and the apical section; a mounting nut captured within the basal section for being engaged with and advanced along the threaded bushing of the switch to mount the boot member over the switch, the mounting nut including a bore complementary to the threaded bushing; a chamber in the apical section, the chamber being dimensioned and configured for receiving the actuator of the switch upon mounting the boot member over the switch; a sealing surface on the basal section for engaging the face of the panel in sealing engagement upon advancing the mounting nut onto the threaded bushing to secure the sealing device over the switch; and a cavity within the mounting nut, the cavity being dimensioned, configured and located for receiving the panel nut therein upon advancement of the mounting nut along the threaded bushing in an axial direction toward the panel, thereby enabling the sealing engagement of the sealing surface with the face of the panel and securement of the sealing device against the panel independent of the panel nut.

Still further, the present invention includes a sealing method for use in connection with sealing a switch with a sealing device, the switch being mounted upon a panel and having a threaded bushing projecting in an axial direction away from a face of the panel and secured to the panel with a panel nut threaded onto the threaded bushing and placed against the face of the panel such that a terminal end of the threaded bushing is spaced an axial distance from the face of the panel, and an actuator extending in the axial direction from the terminal end of the threaded bushing, the sealing method comprising: providing a boot member having a wall constructed of a resiliently flexible elastomeric material, the boot member including a lower basal section, an upper apical section and an intermediate section between the basal section and the apical section; providing a mounting nut captured within the basal section for being engaged with and advanced along the threaded bushing of the switch to mount the boot member over the switch, the mounting nut including a bore complementary to the threaded bushing; providing a chamber in the apical section, the chamber being dimensioned and configured for receiving the actuator of the switch upon mounting the boot member over the switch; providing a sealing surface on the basal section for engaging the face of the panel in sealing engagement upon advancing the mounting nut onto the threaded bushing to secure the sealing device over the switch; providing a cavity within the mounting nut, and dimensioning, configuring and locating the cavity for receiving the panel nut therein; engaging the mounting nut with the threaded bushing and advancing the sealing device along the threaded bushing in an axial direction toward the panel; and continuing to advance the mounting nut along the threaded bushing to receive the panel nut within the cavity and thereby attain sealing engagement of the sealing surface with the face of the panel and securement of the sealing device independent of the panel nut.

BRIEF DESCRIPTION OF THE SEVERAL VIEWS OF THE DRAWING

The invention will be understood more fully, while still further objects and advantages will become apparent, in the following detailed description of preferred embodiments of the invention illustrated in the accompanying drawing, in which.

DETAILED DESCRIPTION OF THE INVENTION

Figure 1:
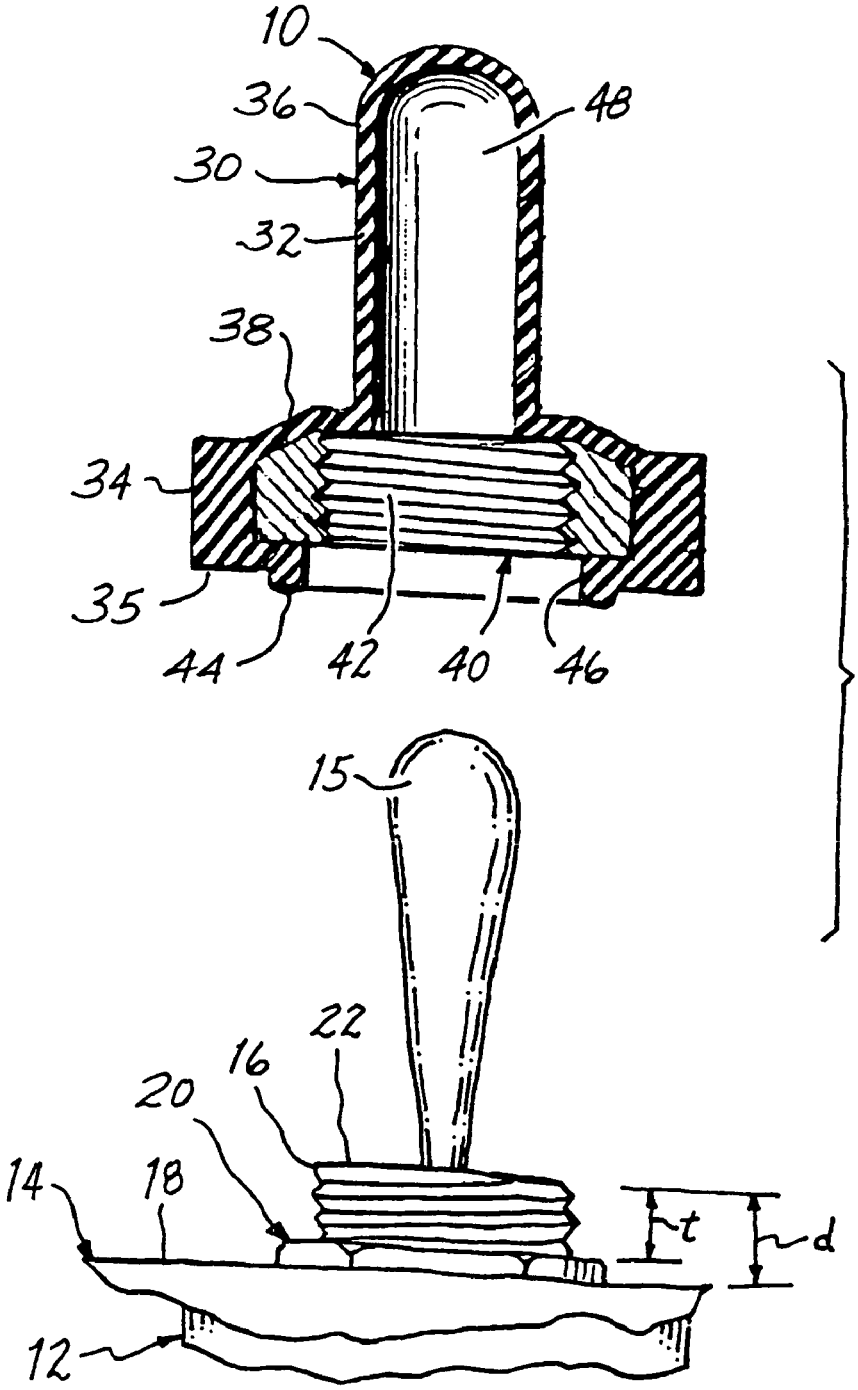
FIG. 1 PRIOR ART
FIG. 1 is an exploded elevational view, with portions in cross-section, showing a switch boot constructed in accordance with the prior art and about to be fitted over an existing installed switch.

Referring now to the drawing, and especially to FIG. 1 thereof, a switch boot constructed in accordance with the prior art is shown at 10 and is seen about to be fitted over an existing installed switch in the form of a toggle switch 12 mounted upon a panel 14 and having an actuator in the form of a toggle handle 15. As is conventional in such installations, switch 12 includes a threaded bushing 16 which extends axially through panel 14 and projects from the front face 18 of panel 14 in an axial direction in order to receive a panel nut 20 which is threaded onto threaded bushing 16 and is seated against front face 18 to secure switch 12 in place, installed on panel 14. Threaded bushing 16 is provided with an axial length long enough to enable switch 12 to be installed in panels of different thicknesses while providing a purchase for panel nut 20 sufficient to secure switch 12 tightly to a selected panel. As a result, the axial distance d between the front face 18 of panel 14 and the terminal end 22 of threaded bushing 16 will vary, and usually will exceed the thickness of panel nut 20 so that threaded bushing 16 projects axially beyond panel nut 20 to expose a threaded length t of threaded bushing 16, now made available for securing switch boot 10 in place when fitted over switch 12, as will be described below.

Switch boot 10 includes a boot member 30 having a wall 32 constructed of a resiliently flexible elastomeric material, such as a silicone rubber. Boot member 30 includes a lower basal section 34 having a basal face 35, an upper apical section 36, and an intermediate section 38 between the basal section 34 and the apical section 36. A mounting nut 40 is affixed to boot member 30, within basal section 34, and includes a threaded bore 42 complementary to threaded bushing 16 along length t of the threaded bushing 16. A sealing surface, shown in the form of a sealing bead 44, is molded unitary with basal section 34 and extends around an opening 46 in basal section 34, opening 46 having a diameter generally complementary to panel nut 20, and opening 46 and bead 44 being concentric with threaded bore 42 of mounting nut 40. Apical section 36 of boot member 30 includes an inner chamber 48 having a configuration and dimensions for enveloping toggle handle 15 of switch 12 when switch boot 10 is in place over switch 12.

Figure 2:
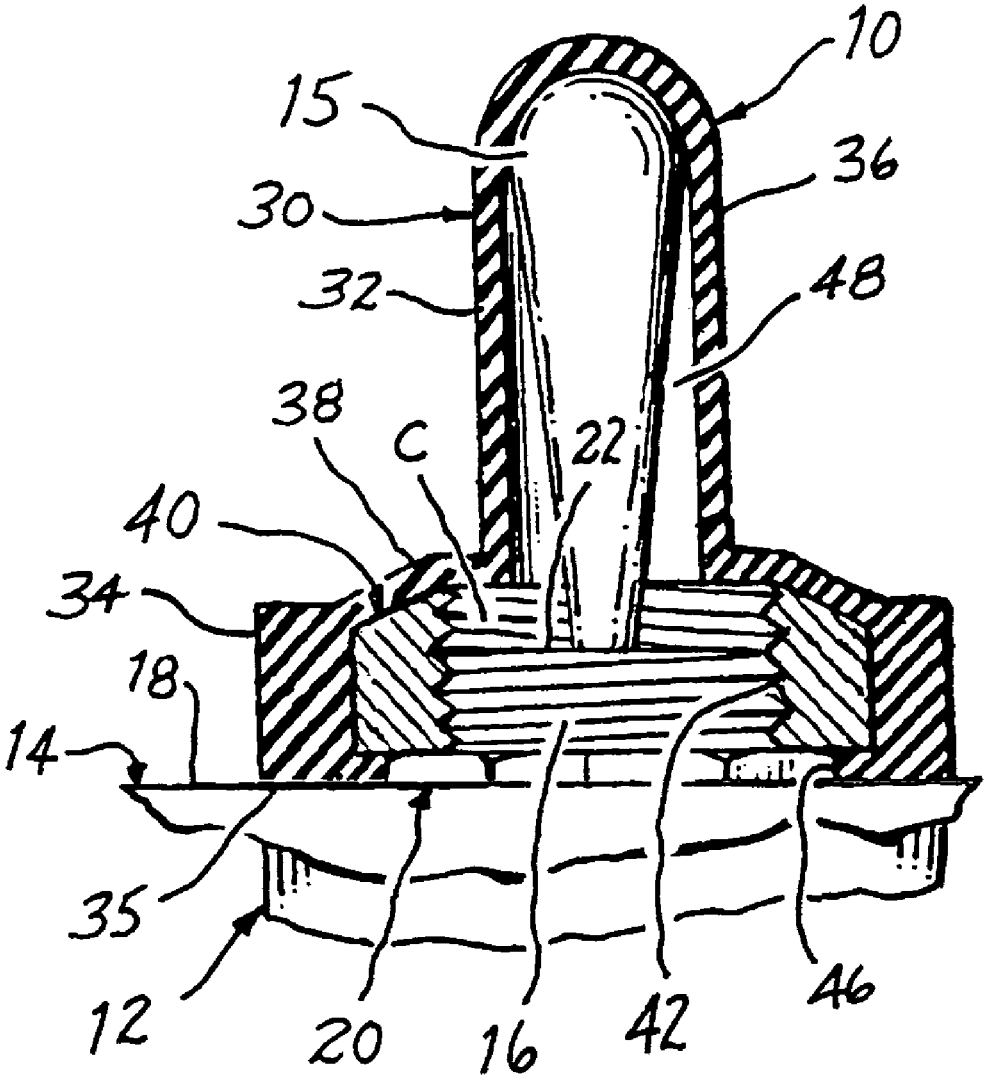
FIG. 2 PRIOR ART
FIG. 2 is a similar elevational view, and showing the switch boot fitted over the installed switch.

Switch boot 10 is to be fitted over switch 12 to protect switch 12 against environmental hazards in the vicinity of the installation where switch 12 resides. Turning now to FIG. 2, as well as with reference to FIG. 1, upon threading mounting nut 40 onto threaded length t of threaded bushing 16, toggle handle 15 will enter chamber 48, mounting nut 40 will be seated against panel nut 20, and basal section 34 will be seated against front face 18 of panel 14. With the basal face 35 of basal section 34 seated against panel 14, sealing bead 44 is urged against the front face 18 of panel 14, thereby sealing switch 12 against the surrounding environment, all as is known in the prior art. As depicted in FIG. 2, upon fitting switch boot 10 over switch 12, with boot member 30 fully seated against panel 14 to complete the desired sealing of switch 12, a sufficient clearance C is available between the terminal end 22 of threaded bushing 16 and intermediate section 38 of boot member 30 to enable the establishment of the desired sealing engagement between sealing bead 44 and panel 14, while avoiding contact between the terminal end 22 of threaded bushing 16 and wall 32 of boot member 30 at the intermediate section 38 of boot member 30.

Figure 3:
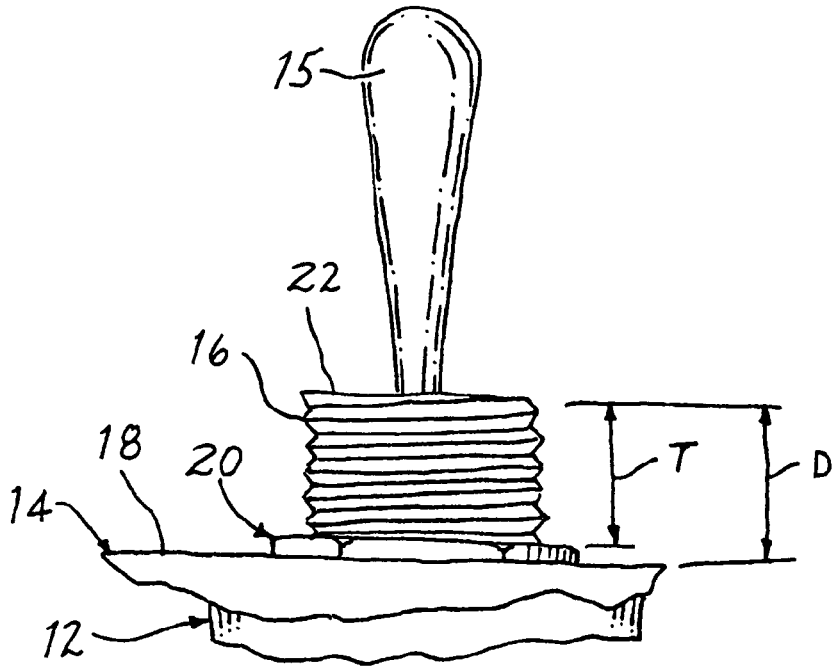
FIG. 3 PRIOR ART
FIG. 3 is an elevational view showing an alternate switch installation.
Figure 4:
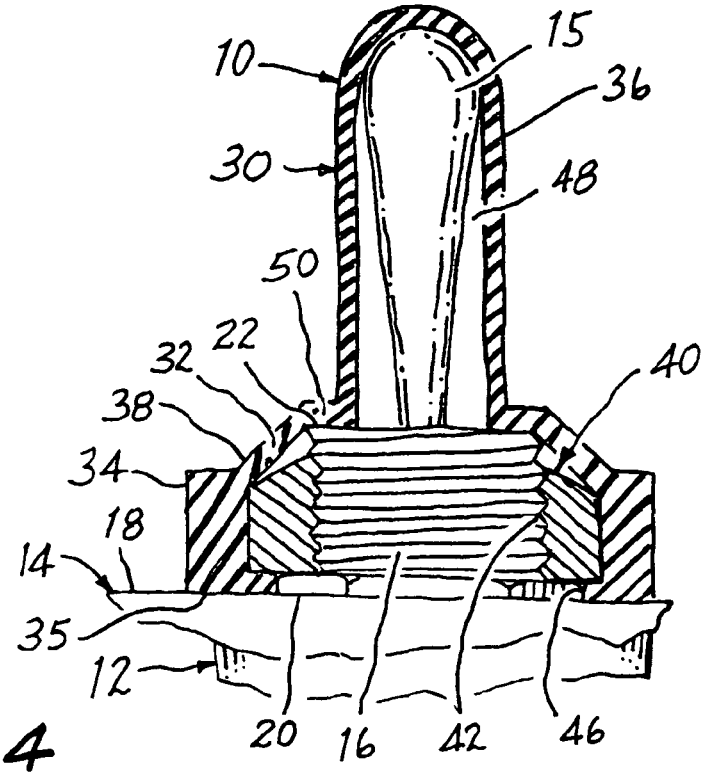
FIG. 4 PRIOR ART
FIG. 4 is an elevational view similar to FIG. 2, and showing the switch boot fitted over the installed switch of FIG. 3.

However, in certain installations encountered in the field, a clearance C is not available, as a result of either a greater axial distance between the front face 18 of panel 14 and the terminal end 22 of the threaded bushing 16, as depicted at D in FIG. 3, due to a particular panel thickness or a particular threaded bushing length, or a greater exposed threaded length of threaded bushing 16, as depicted at T in FIG. 3, due to a particular panel nut thickness, or a combination of these dimensional variations, and terminal end 22 of threaded bushing 16 will engage wall 32 of boot member 30, as seen in FIG. 4 at juxtaposed wall portion 50, the magnitude of axial distance D and threaded length T thus being related to the thickness of panel 14, the length of threaded bushing 16 and the thickness of panel nut 20, any of which parameters can vary from installation to installation.

While the resilient nature of the material of boot member 30 enables the wall 32 at wall portion 50 of intermediate section 38 to stretch, enabling apical section 36 to move axially upwardly, as seen in FIG. 4, and thereby accommodate variations in the magnitudes of axial distance D and threaded length T encountered in the field and assure the attainment of an effective seal between sealing bead 44 and panel 14, the direct contact between terminal end 22 and wall 32 at juxtaposed wall portion 50 has been found to cause excessive wear, and even galling of the material of wall portion 50, both during installation of switch boot 10 and subsequently, during repeated operation of toggle handle 15 of switch 12, resulting in early rupture of wall 32 and consequent premature failure of switch boot 10. Where the magnitude of either or both of axial distance D and threaded length T is great enough, direct contact of the relatively hard and somewhat sharp metallic edges at the terminal end 22 of threaded bushing 16 with the softer material of juxtaposed wall portion 50 of wall 32 of boot member 30 can cause an immediate penetration and rupture of the wall 32, rendering switch boot 10 entirely ineffective.

Figure 5:
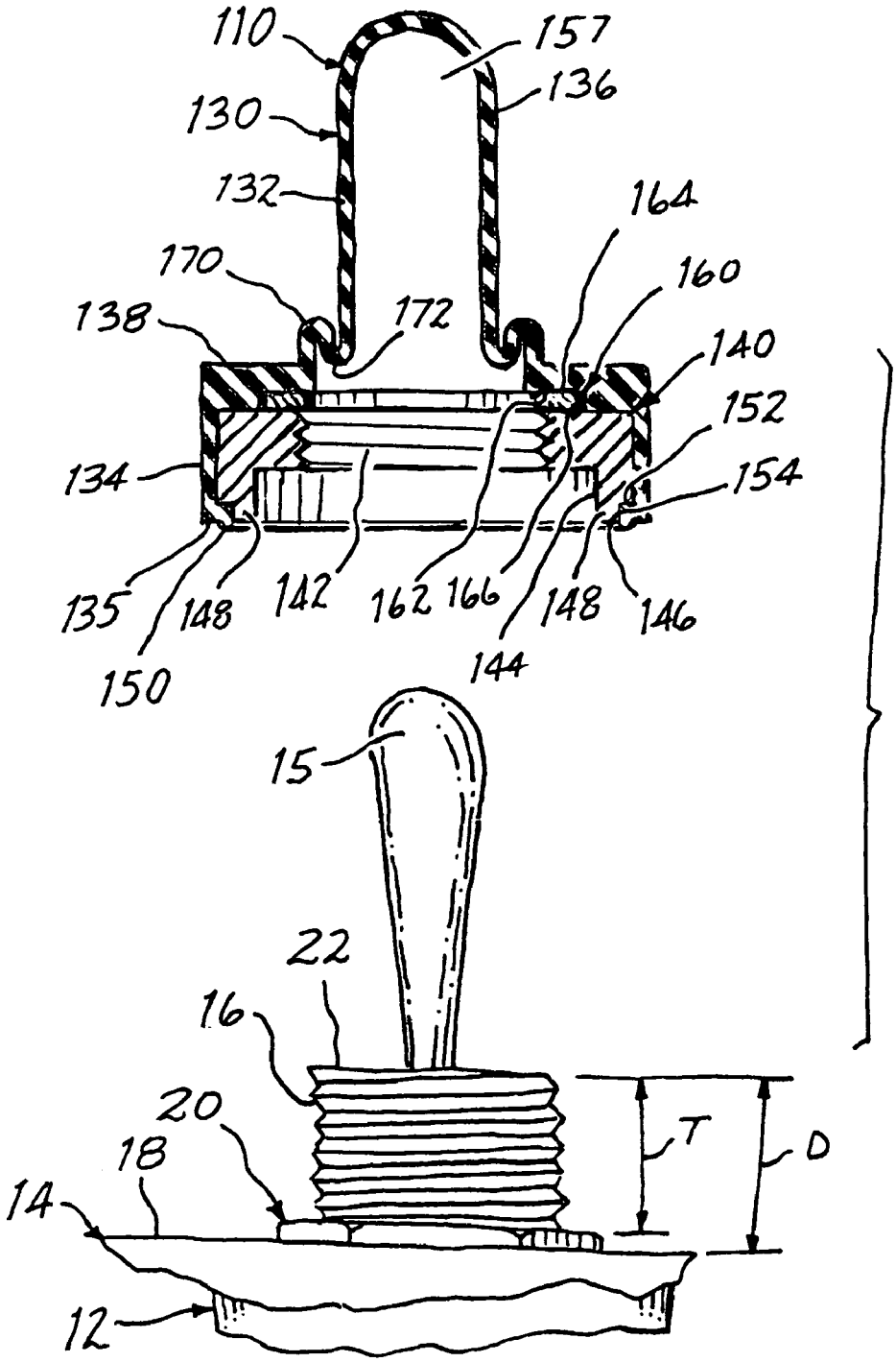
FIG. 5 is an exploded elevational view, with portions in cross-section, showing a switch boot constructed and being used in connection with an existing installed switch in accordance with the present invention.
Figure 6:
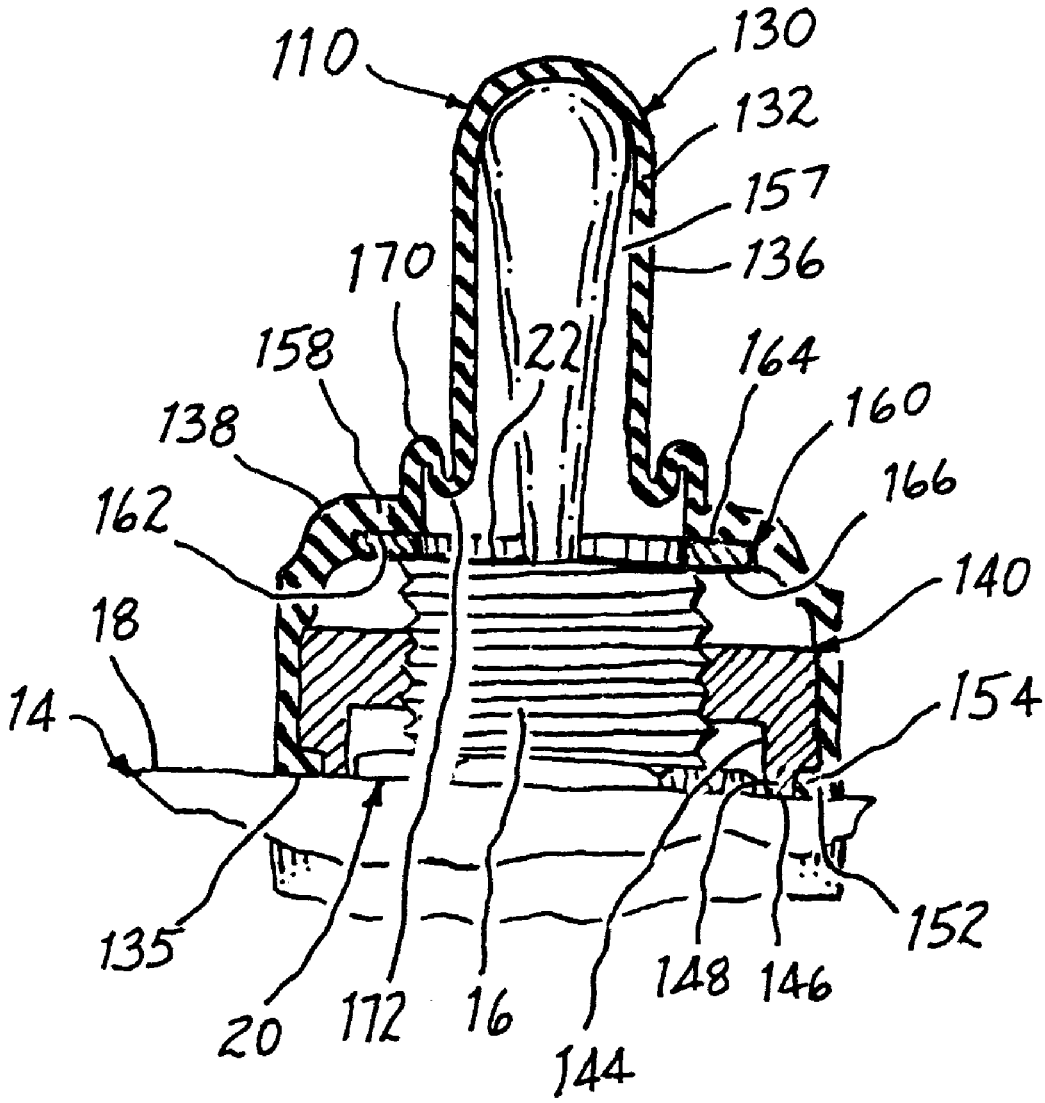
FIG. 6 is a similar elevational view showing the switch boot of FIG. 5 fitted over the installed switch of FIG. 3.

Referring now to FIGS. 5 and 6, the present invention avoids the deleterious direct contact with the terminal end 22 of the threaded bushing 16 of switch 12 as described above, while accommodating variations in the magnitude of either or both of axial distance D and exposed threaded length T encountered in the field and assuring effective sealing of switch 12. A sealing device for use in providing a protective seal over switch 12 and constructed in accordance with the present invention is shown at 110 and is seen about to be fitted over the existing installed toggle switch 12 which is mounted upon panel 14 and has an actuator in the form of toggle handle 15, as described above. Switch boot 110 includes a boot member 130 having a wall 132 constructed of a resiliently flexible elastomeric material, such as a silicone rubber. Boot member 130 includes a lower basal section 134 having a basal face 135, an upper apical section 136, and an intermediate section 138 between the basal section 134 and the apical section 136. A mounting nut 140 is constructed of a harder, more rigid material, such as a metal or a synthetic polymeric material, and is affixed to boot member 130, captured within basal section 134, preferably by molding the boot member 130 integral with the mounting nut 140 to embed and bond the mounting nut 140 within the boot member 130. The mounting nut 140 includes a bore, shown in the form of a threaded bore 142 of predetermined diameter, complementary to threaded bushing 16 along length T of the threaded bushing 16, and a cavity in the form of a counter-bore 144 which extends in the axial direction from the threaded bore 142 to a basal surface 146 located on a cylindrical depending portion 148 of the mounting nut 140. Counter-bore 144 is concentric with and has an internal diameter generally complementary to panel nut 20 for reception of the panel nut 20 within the counter-bore 144, as will be described below.

A sealing surface, shown in the form of a sealing rib 150, is molded unitary with basal section 134 and extends around the outer periphery of cylindrical depending portion 148 of the mounting nut 140, along a radially inwardly-directed annular basal flange 152 of the basal section 134, the annular basal flange 152 preferably being molded integral with an annular groove 154 contiguous with the cylindrical depending portion 148 of the mounting nut 140, with the sealing rib 150 extending slightly axially downwardly from basal face 135, and basal flange 152, to be spaced a short distance downwardly from the basal face 135 and basal surface 146. Cylindrical depending portion 148 and sealing rib 150 are concentric with threaded bore 142 of mounting nut 140, and a shoulder 156 of groove 154 is placed in axial alignment with sealing rib 150 and serves to back up and reinforce basal flange 152 and a seal to be established along sealing rib 150, as will be described below. As before, apical section 136 of boot member 130 includes an inner chamber 157 having a configuration and being dimensioned for enveloping toggle handle 15 of switch 12 when switch boot 110 is installed in place over switch 12.

Upon fitting switch boot 110 over switch 12, boot member 130 is to be fully seated against panel 14 to complete the desired sealing of switch 12, as illustrated in FIG. 6. To that end, sealing rib 150 is urged against front face 18 of panel 14 to assure that sealing rib 150 engages panel 14 in fully sealing engagement. At the same time, where the magnitude of axial distance D is such that the terminal end 22 of threaded bushing 16 is urged toward potential engagement with a portion 158 of wall 132 juxtaposed with terminal end 22, axially upward displacement of the juxtaposed wall portion 158 is required so as to assure full sealing engagement of sealing rib 150 with panel 14. In order to enable such displacement in the upward axial direction, without establishing a deleterious direct contact between the terminal end 22 of the threaded bushing 16 and the material of wall portion 158 of wall 132 juxtaposed with the terminal end 22, a bearing member, shown in the form of an annulus 160 constructed of a material less resiliently flexible and more rigid than the material of wall portion 158, is interposed between the terminal end 22 and the juxtaposed wall portion 158. Preferably, annulus 160 is constructed of a metal, such as a metallic washer, or a substantially rigid synthetic polymeric material.

In the preferred construction, annulus 160 is seated within an annular recess 162 in intermediate section 138 of boot member 130 so as to maintain annulus 160 in a fixed axial alignment with mounting nut 140, with the annular recess 162 confronting the mounting nut 140 and the annulus 160 placed normally contiguous with the mounting nut 140, as seen in FIG. 5. The annulus 160 and the annular recess 162 each have an overall diameter greater than the prescribed diameter of the threaded bore 142 of the mounting nut 140, and the annulus 160 has an internal diameter less than the prescribed diameter of the threaded bore 142 so that the annulus 160 is interposed between the mounting nut 140 and the juxtaposed wall portion 158, in position to be engaged by the terminal end 22 of the threaded bushing 16 for enabling axially upward displacement of the juxtaposed wall portion 158 and, consequently, the apical section 136 in the direction away from panel 14, in response to engagement of the annulus 160 by the terminal end 22 during seating of the switch boot 110 over the switch 12, as illustrated in FIG. 6. In this manner, direct contact between the terminal end 22 and the material of juxtaposed wall portion 158 is precluded, thereby avoiding the deleterious consequences of excessive wear and possible galling, leading to premature failure, and even rupture, of boot member 130. Further, the surface area of annulus 160, along upper surface 164 of the annulus 160 and along lower surface 166, between the inner diameter and the overall diameter of the annulus 160, combined with an intimate contact between the upper surface 164 of the annulus 160 and the juxtaposed wall portion 158 of wall 132, tends to dissipate forces exerted against the lower surface 166 of the annulus 160 by the terminal end 22 of threaded bushing 16 and reduce stresses placed upon juxtaposed wall portion 158 resulting from contact between terminal end 22 and annulus 160, thereby militating against failure of the wall 132 of boot member 130.

At the same time, downward movement of mounting nut 140 along threaded bushing 16, in the axial direction toward panel 14, to seat switch boot 110 upon panel 14 is limited by the engagement of basal surface 146 of cylindrical depending portion 148 with front face 18 of panel 14. Thus, basal surface 146 serves as a stop surface which limits the downward movement of mounting nut 140 to that which is sufficient to establish a seal along sealing rib 150 while providing a positive tactile indication of the completion of a full sealing engagement. Consequently, compressive stresses upon sealing rib 150 are controlled in a more positive manner and are limited to those forces which will compress sealing rib 150 into the desired sealing engagement, while upward displacement of juxtaposed wall portion 158 also is limited. In this manner, both excessive compressive stresses upon sealing rib 150 and unnecessarily excessive tensile stresses in wall portion 158 are avoided, thereby extending the longevity of switch boot 110. Moreover, engagement of basal surface 146 directly with front face 18 of panel 14, as permitted by the reception of panel nut 20 within counter-bore 144, rather than engagement between mounting nut 140 and panel nut 20, as illustrated in connection with the above description of prior art wherein mounting nut 40 becomes seated against panel nut 20, provides a more positive and better controlled securement of switch boot 110 in place over switch 12, as well as an effective seal, independent of the thickness of panel nut 20 or the position of panel nut 20 along threaded bushing 16.

Further, upward displacement of juxtaposed wall portion 158, as described above, will move apical section 136 of wall 132 upwardly as well, thereby assuring appropriate entry into and envelopment of toggle handle 15 of switch 12 within chamber 157 of apical section 136. A connector wall portion 170 between the apical section 136 and the intermediate section 138 of wall 132 of boot member 130 is provided with an undulant configuration at 172 which facilitates manipulation of the apical section 136 in lateral directions during operation of the toggle handle 15 of switch 12 and further preserves the integrity of the material of wall 132 over a longer service life.

It will be seen that the present invention attains all of the objects and advantages summarized above, namely: Provides a switch boot for an existing panel-mounted switch with a construction which accommodates variations in existing switch installations encountered in the field to establish an exemplary seal; avoids deleterious direct contact between the resilient material of the switch boot and component parts of a mounted switch to militate against excessive wear leading to damage and consequent premature failure of an installed switch boot; enhances the seal provided by a switch boot and preserves the enhanced seal over a longer service life; enables greater ease of installation of a switch boot and the establishment of an exemplary seal without disturbing the existing mounting arrangement of the switch itself better accommodates variations in configurations and dimensions of installed switches, as well as variations in existing installations encountered in the field, to accomplish an effective seal with increased longevity; provides a more rugged switch boot, capable of exemplary performance over an extended service life.

It is to be understood that the above detailed description of preferred embodiments of the invention is provided by way of example only. Various details of design, construction and procedure may be modified without departing from the true spirit and scope of the invention, as set forth in the appended claims.

The embodiments of the invention in which an exclusive property or privilege is claimed are defined as follows:

1. A sealing device for use in connection with a switch mounted upon a panel and having a threaded bushing projecting in an axial direction away from a face of the panel and secured to the panel with a panel nut engaged with the threaded bushing and placed against the face of the panel such that a terminal end of the threaded bushing is spaced an axial distance from the face of the panel, and an actuator extending in the axial direction from the terminal end of the threaded bushing, the sealing device comprising:

a boot member having a wall constructed of a resiliently flexible elastomeric material, the boot member including a lower basal section, an upper apical section and an intermediate section between the basal section and the apical section;

a mounting nut captured within the basal section for being engaged with and advanced along the threaded bushing of the switch to mount the boot member over the switch, the mounting nut including a bore complementary to the threaded bushing;

a chamber in the apical section, the chamber being dimensioned and configured for receiving the actuator of the switch upon mounting the boot member over the switch;

a sealing surface on the basal section for engaging the face of the panel in sealing engagement upon advancing the mounting nut onto the threaded bushing to secure the sealing device over the switch; and a bearing member placed within the intermediate section of the boot member, axially between the mounting nut and the apical section, in position to be interposed between the terminal end of the threaded bushing and a juxtaposed portion of the wall of the boot member along the intermediate section upon mounting the boot member upon the switch, the bearing member being constructed of a material less resiliently flexible than the elastomeric material of the wall, such that direct engagement of the terminal end of the threaded bushing with the elastomeric material of the juxtaposed portion of the wall of the intermediate section is precluded while displacement of the apical section relative to the basal section is enabled in the axial direction in response to engagement of the bearing member with the terminal end of the threaded bushing upon advancement of the sealing surface toward sealing engagement with the face of the panel so as to accommodate variations in the axial distance between the terminal end of the threaded bushing and the face of the panel while assuring sealing engagement of the sealing surface with the face of the panel.

2. The sealing device of claim 1 wherein the intermediate section includes a recess confronting the mounting nut, and the bearing member is seated within the recess, between the mounting nut and the juxtaposed wall portion of the wall of the boot member.

3. The sealing device of claim 1 wherein the bore of the mounting nut has a prescribed diameter and the bearing member comprises an annulus having an internal diameter less than the prescribed diameter of the bore and an overall diameter greater than the prescribed diameter of the bore such that the annulus will be engaged by the terminal end of the threaded bushing upon advancing the mounting nut along the threaded bushing.

4. The sealing device of claim 3 wherein the annulus is placed contiguous with the mounting nut in position to be displaced away from the mounting nut in response to engagement with the terminal end of the threaded bushing upon advancing the mounting nut along the threaded bushing.

5. The sealing device of claim 3 wherein the intermediate section includes an annular recess confronting the mounting nut, and the annulus is seated within the recess, between the mounting nut and the juxtaposed wall portion.

6. The sealing device of claim 5 wherein the annulus is placed contiguous with the mounting nut in position to be displaced away from the mounting nut in response to engagement with the terminal end of the threaded bushing upon advancing the mounting nut along the threaded bushing.

7. The sealing device of claim 6 wherein the annulus is constructed of a metal.

8. The sealing device of claim 1 including a cavity within the mounting nut, the cavity being dimensioned, configured and located for receiving the panel nut therein upon advancement of the mounting nut along the threaded bushing, thereby enabling the sealing engagement of the sealing surface with the face of the panel and securement of the sealing device against the panel independent of the panel nut.

9. The sealing device of claim 1 wherein:

the mounting nut includes a basal surface for engaging the face of the panel upon movement of the sealing device in an axial direction toward the face of the panel to seat the basal surface against the face of the panel and secure the sealing device in place over the switch; and the sealing surface is spaced away from the basal surface by an axial distance sufficient to attain sealing engagement between the sealing surface and the panel upon seating of the basal surface against the face of the panel.

10. The sealing device of claim 9 wherein the sealing surface is located on a sealing rib molded unitary with the basal section of the boot member.

11. The sealing device of claim 9 including a cavity in the mounting nut, the cavity being dimensioned, configured and located within the mounting nut, concentric with the sealing surface, for receiving the panel nut upon movement of the sealing device in the axial direction toward the face of the panel to enable seating of the sealing surface against the face of the panel and securement of the sealing device against the panel independent of the panel nut.

12. A sealing method for use in connection with sealing a switch with a sealing device, the switch being mounted upon a panel and having a threaded bushing projecting in an axial direction away from a face of the panel and secured to the panel with a panel nut threaded onto the threaded bushing and placed against the face of the panel such that a terminal end of the threaded bushing is spaced an axial distance from the face of the panel, and an actuator extending in the axial direction from the terminal end of the threaded bushing, the sealing method comprising:

providing a boot member having a wall constructed of a resiliently flexible elastomeric material, the boot member including a lower basal section, an upper apical section and an intermediate section between the basal section and the apical section;

providing a mounting nut captured within the basal section for being engaged with and advanced along the threaded bushing of the switch to mount the boot member over the switch, the mounting nut including a bore complementary to the threaded bushing;

providing a chamber in the apical section, the chamber being dimensioned and configured for receiving the actuator of the switch upon mounting the boot member over the switch;

providing a sealing surface on the basal section for engaging the face of the panel in sealing engagement upon advancing the mounting nut onto the threaded bushing to secure the sealing device over the switch;

placing a bearing member within the intermediate section of the boot member, axially between the mounting nut and the apical section, in position to be interposed between the terminal end of the threaded bushing and a juxtaposed portion of the wall of the boot member along the intermediate section upon mounting the boot member upon the switch, the bearing member being constructed of a material less resiliently flexible than the elastomeric material of the juxtaposed portion of the wall; and engaging the mounting nut with the threaded bushing and moving the sealing device along the threaded bushing in an axial direction toward the panel such that direct engagement of the terminal end of the threaded bushing with the elastomeric material of the wall of the intermediate section is precluded by the interposed bearing member while displacement of the apical section relative to the basal section is enabled in the axial direction away from the panel in response to engagement of the bearing member with the terminal end of the threaded bushing upon axial movement of the sealing surface toward sealing engagement with the face of the panel so as to accommodate variations in the axial distance between the terminal end of the threaded bushing and the face of the panel while assuring sealing engagement of the sealing surface with the face of the panel.

13. The sealing method of claim 12 including providing a recess in the intermediate section confronting the mounting nut, and seating the bearing member within the recess, between the mounting nut and the juxtaposed portion of the wall of the boot member.

14. The sealing method of claim 12 wherein the bore of the mounting nut has a prescribed diameter, the method including providing the bearing member in the form of an annulus having an internal diameter less than the prescribed diameter of the bore and an overall diameter greater than the prescribed diameter of the bore such that the annulus will be engaged by the threaded bushing upon advancing the mounting nut along the threaded bushing.

15. The sealing method of claim 14 including placing the annulus contiguous with the mounting nut in position to be displaced away from the mounting nut in response to engagement with the terminal end of the threaded bushing upon advancing the mounting nut along the threaded bushing.

16. The sealing method of claim 14 including providing an annular recess in the intermediate section confronting the mounting nut, and seating the annulus within the recess, between the mounting nut and the juxtaposed portion of the wall of the boot member.

17. The sealing method of claim 16 including placing the annulus contiguous with the mounting nut in position to be displaced away from the mounting nut in response to engagement with the terminal end of the threaded bushing upon advancing the mounting nut along the threaded bushing.

18. The sealing method of claim 17 including constructing the annulus of a metal.

19. The sealing method of claim 12 including providing a cavity within the mounting nut, and dimensioning, configuring and locating the cavity for receiving the panel nut therein, and then advancing the mounting nut along the threaded bushing to receive the panel nut within the cavity and thereby attain sealing engagement of the sealing surface with the face of the panel and securement of the sealing device independent of the panel nut.

20. The sealing method of claim 12 including:

providing the mounting nut with a basal surface located for engaging the face of the panel upon movement of the sealing device along the threaded bushing in an axial direction toward the panel;

spacing the sealing surface away from the basal surface by an axial distance sufficient to attain sealing engagement between the sealing surface and the panel upon seating of the basal surface against the face of the panel to seat the basal surface against the face of the panel and secure the sealing device over the switch; and moving the sealing device along the threaded bushing in an axial direction toward the panel to seat the basal surface against the face of the panel, thereby effecting sealing engagement between the sealing surface and the panel and securing the sealing device in place over the switch.

21. The sealing method of claim 20 including providing a cavity in the mounting nut, and dimensioning, configuring and locating the cavity for receiving the panel nut therein, and then advancing the mounting nut along the threaded bushing to receive the panel nut within the cavity and thereby attain sealing engagement of the sealing surface with the face of the panel and securement of the sealing device against the panel independent of the panel nut.

22. The sealing method of claim 20 including locating the sealing surface on a sealing rib molded unitary with the basal section of the boot member.

23. A sealing device for use in connection with a switch mounted upon a panel and having a threaded bushing projecting in an axial direction away from a face of the panel and secured to the panel with a panel nut engaged with the threaded bushing and placed against the face of the panel such that a terminal end of the threaded bushing is spaced an axial distance from the face of the panel, and an actuator extending in the axial direction from the terminal end of the threaded bushing, the sealing device comprising:

a boot member having a wall constructed of a resiliently flexible elastomeric material, the boot member including a lower basal section, an upper apical section and an intermediate section between the basal section and the apical section;

a mounting nut captured within the basal section for being engaged with and advanced along the threaded bushing of the switch to mount the boot member over the switch, the mounting nut including a bore complementary to the threaded bushing;

a chamber in the apical section, the chamber being dimensioned and configured for receiving the actuator of the switch upon mounting the boot member over the switch;

a sealing surface on the basal section for engaging the face of the panel in sealing engagement upon advancing the mounting nut onto the threaded bushing to secure the sealing device over the switch; and a cavity within the mounting nut, the cavity being dimensioned, configured and located for receiving the panel nut therein upon advancement of the mounting nut along the threaded bushing in an axial direction toward the panel, thereby enabling the sealing engagement of the sealing surface with the face of the panel and securement of the sealing device against the panel independent of the panel nut.

24. The sealing device of claim 23 wherein:

the mounting nut includes a basal surface for engaging the face of the panel upon movement of the sealing device in the axial direction toward the face of the panel to seat the basal surface against the face of the panel and secure the sealing device in place over the switch; and the sealing surface is spaced away from the basal surface by an axial distance sufficient to attain sealing engagement between the sealing surface and the panel upon seating of the basal surface against the face of the panel.

25. The sealing device of claim 24 wherein the sealing surface is located on a sealing rib molded unitary with the basal section of the boot member.

26. A sealing method for use in connection with sealing a switch with a sealing device, the switch being mounted upon a panel and having a threaded bushing projecting in an axial direction away from a face of the panel and secured to the panel with a panel nut threaded onto the threaded bushing and placed against the face of the panel such that a terminal end of the threaded bushing is spaced an axial distance from the face of the panel, and an actuator extending in the axial direction from the terminal end of the threaded bushing, the sealing method comprising:

providing a boot member having a wall constructed of a resiliently flexible elastomeric material, the boot member including a lower basal section, an upper apical section and an intermediate section between the basal section and the apical section;

providing a mounting nut captured within the basal section for being engaged with and advanced along the threaded bushing of the switch to mount the boot member over the switch, the mounting nut including a bore complementary to the threaded bushing;

providing a chamber in the apical section, the chamber being dimensioned and configured for receiving the actuator of the switch upon mounting the boot member over the switch;

providing a sealing surface on the basal section for engaging the face of the panel in sealing engagement upon advancing the mounting nut onto the threaded bushing to secure the sealing device over the switch;

providing a cavity within the mounting nut, and dimensioning, configuring and locating the cavity for receiving the panel nut therein;

engaging the mounting nut with the threaded bushing and advancing the sealing device along the threaded bushing in an axial direction toward the panel; and continuing to advance the mounting nut along the threaded bushing to receive the panel nut within the cavity and thereby attain sealing engagement of the sealing surface with the face of the panel and securement of the sealing device independent of the panel nut.

27. The sealing method of claim 26 including:

providing the mounting nut with a basal surface located for engaging the face of the panel upon movement of the sealing device along the threaded bushing in the axial direction toward the panel;

spacing the sealing surface away from the basal surface by an axial distance sufficient to attain sealing engagement between the sealing surface and the panel upon seating of the basal surface against the face of the panel to seat the sealing surface against the face of the panel and secure the sealing device over the switch; and seating the basal surface against the face of the panel while effecting the sealing engagement between the sealing surface and the panel and securing the sealing device in place over the switch.

28. The sealing method of claim 27 including locating the sealing surface on a sealing rib molded unitary with the basal section of the boot member.

* * * * *